US005488205A

United States Patent [19]

Major

[11] Patent Number: 5,488,205

[45] Date of Patent: Jan. 30, 1996

[54] HEARING AID TUBING CONNECTOR

[75] Inventor: Miklos Major, Ambridge, Pa.

[73] Assignee: Microsonic, Inc., Ambridge, Pa.

[21] Appl. No.: 384,697

[22] Filed: Feb. 6, 1995

Related U.S. Application Data

[63] Continuation of Ser. No. 115,905, Sep. 1, 1993, abandoned.

[51] Int. Cl.[6] ..... H04R 25/00

[52] U.S. Cl. ..... 181/129; 181/130

[58] Field of Search ..... 181/129, 130, 181/135, 137; 381/68.6, 68.7, 69

[56] References Cited

U.S. PATENT DOCUMENTS

| | | | |
|---|---|---|---|
| 2,738,850 | 3/1956 | Tooker . | |
| 3,097,059 | 7/1963 | Hoffman . | |
| 3,368,644 | 2/1968 | Henderson | 181/130 |
| 3,431,370 | 3/1969 | Crosby . | |
| 3,813,499 | 5/1974 | Vignini . | |
| 4,091,067 | 5/1978 | Kramer et al. . | |
| 4,311,206 | 1/1982 | Johnson . | |
| 4,349,083 | 9/1982 | Bennett . | |
| 4,381,830 | 5/1983 | Jelonek et al. | 181/130 X |
| 4,392,547 | 7/1983 | Baker . | |
| 4,442,917 | 4/1984 | Johnson . | |
| 4,677,675 | 6/1987 | Killion et al. . | |
| 4,811,402 | 3/1989 | Ward . | |
| 4,977,976 | 12/1990 | Major | 181/130 |

OTHER PUBLICATIONS

Jack Katz, ed., "Handbook of Clinical Audiology", p. 611, 1972.

Plasticast Models Co., Plasticast Stock Items List, Jun., 1961.

Earmold Design Inc., Earmold Design Catalog, p. 12, 1975.

Microsonic Inc., "Custom Earmold Manual", pp. 36 & 46, 1986.

*Primary Examiner*—Khanh Dang

*Attorney, Agent, or Firm*—Kirkpatrick & Lockhart

[57] ABSTRACT

A hearing aid tubing connector for connecting sound conduction tubing from a hearing aid to an earmold and a method for making same wherein the sound conduction tubing extends completely through a bore in the earmold up to the interior opening of the bore near the eardrum. A connector circumferentially attached to the tubing and having a stepped portion engaging the wall of said bore connects in an acoustic seal the tubing to the exterior opening of the bore in the earmold. The tubing extending through the bore in the earmold has an interior diameter which increases between the exterior opening of the bore and the interior opening of the bore. This increase in the tubing may be continuous or stepped. The tubing may be made of PVC and the earmold may be made of silicone.

16 Claims, 3 Drawing Sheets

HEARING AID TUBING CONNECTOR

This is a continuation of application Ser. No. 08/115,905 filed on Sep. 1, 1993, now abandoned.

BACKGROUND OF THE INVENTION

1. Field of the Invention

The present invention relates to hearing aids. More particularly, the present invention relates to a hearing aid tubing connector which connects earmold tubing from a hearing aid to an earmold without glue between the tubing and the earmold and in which the tubing increases in diameter within the earmold.

DESCRIPTION OF THE INVENTION BACKGROUND

A conventional hearing aid apparatus includes a hearing aid device having a sound exit port and flexible plastic sound conduction tubing attached to the exit port. Such tubing is typically permanently attached to a sound input port in an often custom-made earmold which may be disposed in the ear of the wearer. Sound travels from the hearing aid, through the tubing and through a bore in the earmold directly into the user's ear canal. In such a design, tubing replacement is difficult and costly. The permanently attached tubing must be cut from the earmold and new tubing reattached, or the entire tubing and earmold assembly must be replaced.

An increase in the diameter of the sound conduction path at a point near the input port of the earmold is known in the art. The increase in diameter provides an enhanced high frequency response. The increase may be continuous or stepped up within the tubing. This increase has been accomplished, for instance, by cementing together two sections of sound conduction tubing with different diameters, or by molding a sound conduction tube with an internal step-up in diameter. In the prior art devices, the increase in the diameter of the sound conduction path occurs outside the earmold itself.

Earmolds are fabricated from different chemical compounds. The compound chosen by the fitter of an earmold depends on such factors as the hardness of the pinna, or outer ear, the power range of the hearing aid, allergy conditions of the wearer and the color desired. For instance, polyvinyl chloride (PVC) and silicone are softer materials, polymethyl methacrylate and polyethyl methacrylate are non-toxic and good for most allergy cases, and polymethyl methacrylate and silicone are available in many different colors. The sound conduction tubing is typically made of PVC.

Typically, the sound conduction tubing is attached to the sound input port in an earmold by using glue. However, attachment using glue cannot be made if the tubing is made of PVC and the earmold is made of silicone, because the glue will not sufficiently fuse the materials together. Consequently, connectors have been sought which connect PVC tubing to silicone earmolds.

A means for connecting flexible sound conduction tubing from a hearing aid to a conventional earmold is disclosed in my U.S. Pat. No. 4,977,976. That patent discloses an elbow shaped connector with a sound bore therein. The connector includes a stepped portion on one end which engages with the bore of an earmold, creating an acoustic seal, and a notched end which engages the plastic tubing in an acoustic seal. Thus, the tubing is connected via the elbow shaped connector to the earmold. This permits easy replacement of tubing. That patent also discloses that the sound passage through the elbow shaped connector has an increase in bore size, which may be continuous or stepped, for enhanced high frequency response.

Attaching the tubing to the earmold using an elbow shaped connector, as in the above referenced patent, requires utilization of the additional part of the connector itself. Thus, the connector is an additional, separate part which can be misplaced or become misshaped. Additionally, the tubular sound passage of the connector at the notched end must be formed to have the identical interior diameter as the sound conduction tubing and the tubular sound passage of the connector at the stepped end must be formed to have the identical interior diameter as the sound conduction bore of the earmold. The notched and stepped end portions also must be formed so that they form the acoustic seal with the sound conduction tubing and the sound conduction bore of the earmold.

SUMMARY OF THE INVENTION

The present invention relates to a means for connecting sound conduction tubing from a hearing aid to an earmold and a method for making the same wherein the sound conduction tubing extends completely through a bore in the earmold up to the interior opening of the bore near the eardrum. A connector circumferentially attached to the tubing and having a stepped portion engaging the wall of said bore connects in an acoustic seal the tubing to the exterior opening of the bore in the earmold. The tubing extending through the bore in the earmold may be of constant interior diameter or may have an interior diameter which increases between the exterior opening of the bore and the interior opening of the bore. This increase in the tubing may be continuous or stepped. The tubing and connector may be made of PVC and the earmold may be made of silicone.

As such, it is an object of the present invention to provide a means of connecting sound conduction tubing to an earmold without using glue between the tubing and the earmold.

It is another object of the present invention to provide a means of connecting sound conduction tubing to an earmold without requiring matching the interior diameter of the tubing with either a connector or the earmold bore.

A further object of the present invention is to provide a means of increasing the size of the diameter of the sound conduction tubing within the earmold, after the connection of the tubing to the earmold.

These and other objects and advantages of this invention will become apparent as the following description and accompanying drawings are considered.

BRIEF DESCRIPTION OF THE DRAWINGS

In order that the present invention may be clearly understood and readily practiced, preferred embodiments will now be described, by way of example only, with reference to the accompanying figures wherein.

DETAILED DESCRIPTION OF THE PREFERRED EMBODIMENT

Figure 1:
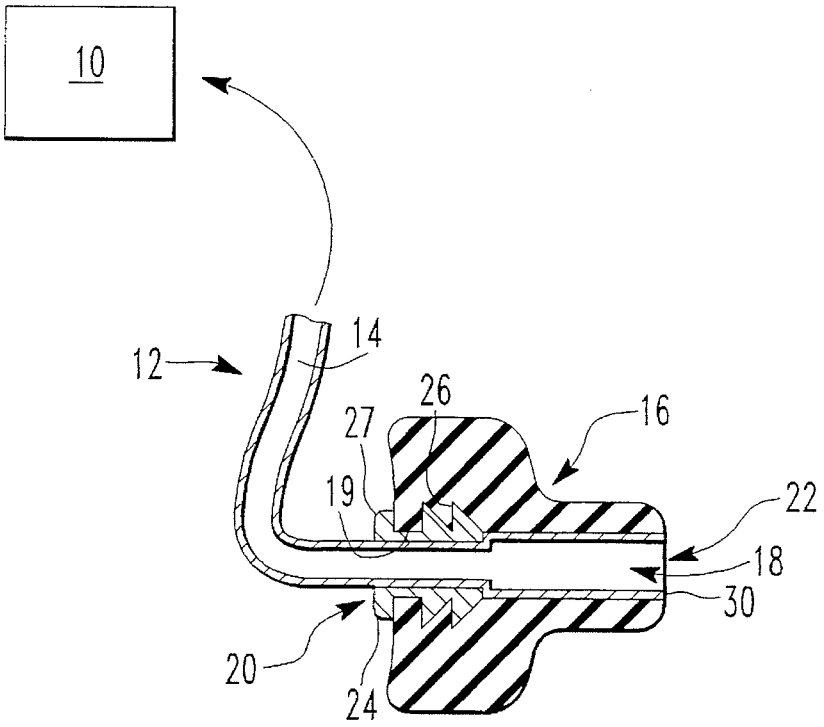
FIG. 1 is a cross-sectional view of one embodiment of an earmold, sound conduction tubing and connector according to the present invention.
Figure 2:
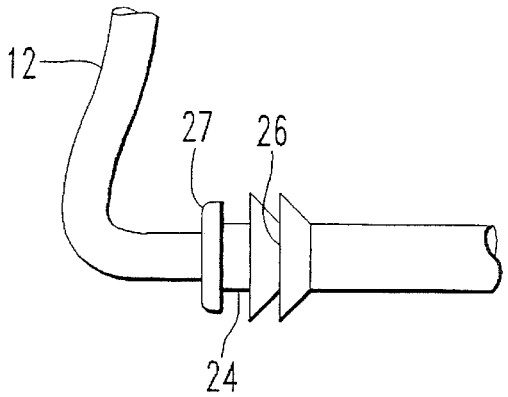
FIG. 2 is a side view of sound conduction tubing and a connector engaged therewith according to the embodiment of the invention shown in FIG. 1.

A conventional hearing aid, generally indicated as 10 in FIG. 1, has a sound exit port to which flexible plastic sound conduction tubing 12, typically PVC, is attached. Such tubing 12 has an internal passage 14 through which sound waves travel.

An earmold 16 is specially molded from a plastic material to conform to the ear of the wearer. Such plastic materials suitable for use as an earmold include, without limitation, PVC, silicone, polymethyl methacrylate and polyethyl methacrylate. The earmold 16 includes a bore 18 extending from exterior opening 20 in earmold 16 through its length to an interior opening 22 in earmold 16. In the conventional hearing aid, sound waves pass through the bore 18 in the earmold 16 into the ear canal of the wearer. In the present invention, tubing 12 extends through bore 18 via exterior bore opening 20 in earmold 16, and interior tube opening 30 ends at interior bore opening 22 in earmold 16. Of course, embodiments can be made wherein interior tube opening 30 ends inside the interior of bore 18 before reaching interior opening 22.

Figure 3:
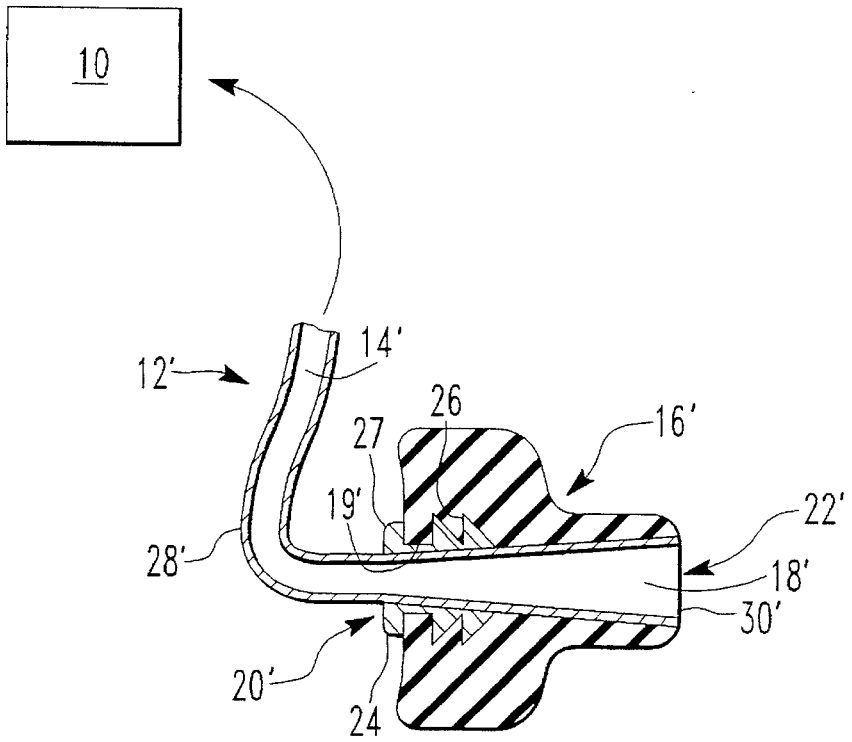
FIG. 3 is a cross-sectional view of another embodiment of an earmold, sound conduction tubing and a connector according to the invention.
Figure 4:
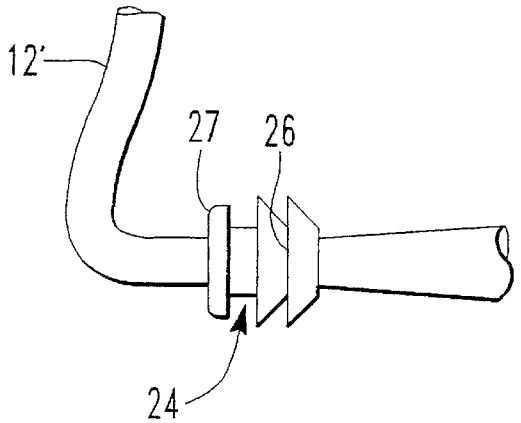
FIG. 4 is a side view of sound conduction tubing and a connector engaged therewith according to the embodiment of the invention shown in FIG. 3.

I prefer that the sound conduction tubing 12 contain an increase in interior diameter in that portion which will be received in earmold 16 for enhanced high frequency response. Such an increase could cause the interior diameter to, for example, rapidly change from 2 mm to 3 mm or 4 mm. Of course, the sound conduction tubing can, alternatively be of constant diameter of, for example, 2 mm. In an alternative embodiment of the invention shown in FIGS. 3 and 4, the sound conduction tubing 12' gradually increases in diameter in the area within the earmold 16'. Such an increase may be from 2 mm to 3 mm or 4 mm in the area between exterior opening 20' to interior opening 22'. In any event, the bore 18 or 18' in the earmold 16 or 16', respectively, preferably has an interior shape corresponding to the exterior shape of the tubing 12 or 12' which is disposed therein.

The connector 24 is molded to fit circumferentially around tubing 12 or 12' as the case may be. Connector 24 is molded of hard plastic such as nylon and is of a sufficient interior diameter to snugly engage tubing 12 or 12' so as to allow its manual insertion therein and to be retained thereon. A small amount of glue is applied to secure the connector 24 to the tubing 12 or 12'. Connector 24 has an inclined stepped portion 26 which is dimensioned to conform to exterior opening 20 or 20' of bore 18 or 18' in earmold 16 or 16' respectively, creating mechanical retention and an acoustic seal between stepped portion 26 and bore wall 19 or 19' when exterior opening 20 or 20' receives stepped portion 26. Flange 27 is formed as part of connector 24 and limits the depth to which connector 24 can be inserted into the earmold 16 or 16'.

To attach tubing 12 or 12' to the earmold 16 or 16', the tubing 12 or 12' is inserted into the respective exterior bore opening 20 or 20' and slid through bore 18 or 18' until the previously-attached connector 24 contacts exterior bore opening 20 or 20'. Connector 24 is then pushed into exterior bore opening 20 or 20' to create an acoustic seal between stepped portion 26 and bore wall 19 or 19' respectively. Connector 24 is pushed into exterior bore opening 20 or 20' until flange 27 abuts earmold 16 or 16' respectively Flange 27 prevents connector 24 from being pushed further into bore 18 or 18' respectively. Excess tubing 12 or 12' which extends from interior bore opening 22 or 22' can be trimmed to form interior tube opening 30 or 30' even with interior bore opening 22 or 22', respectively. This allows tubing 12 or 12' to be sold at a single length which can be adapted to various sizes of earmold 16 or 16'.

Sound conduction tubing 12 or 12' may be formed with elbow 28 or 28' or other such shapes to adapt to the configuration of the earmold 16 or 16' the ear and the hearing aid 10. Because the tubing 12 or 12' and connector 24 assembly does not require glue to be attached to earmold 16 or 16' tubing 12 or 12' and earmold 16 or 16' can be made from materials which do not adhere well using glue. For instance, tubing 12 or 12' can be constructed of PVC, connector 24 of nylon and earmold 16 or 16' of silicone. Tubing 12 or 12' and connector 24 must be of materials which adhere using glue.

Figure 5:
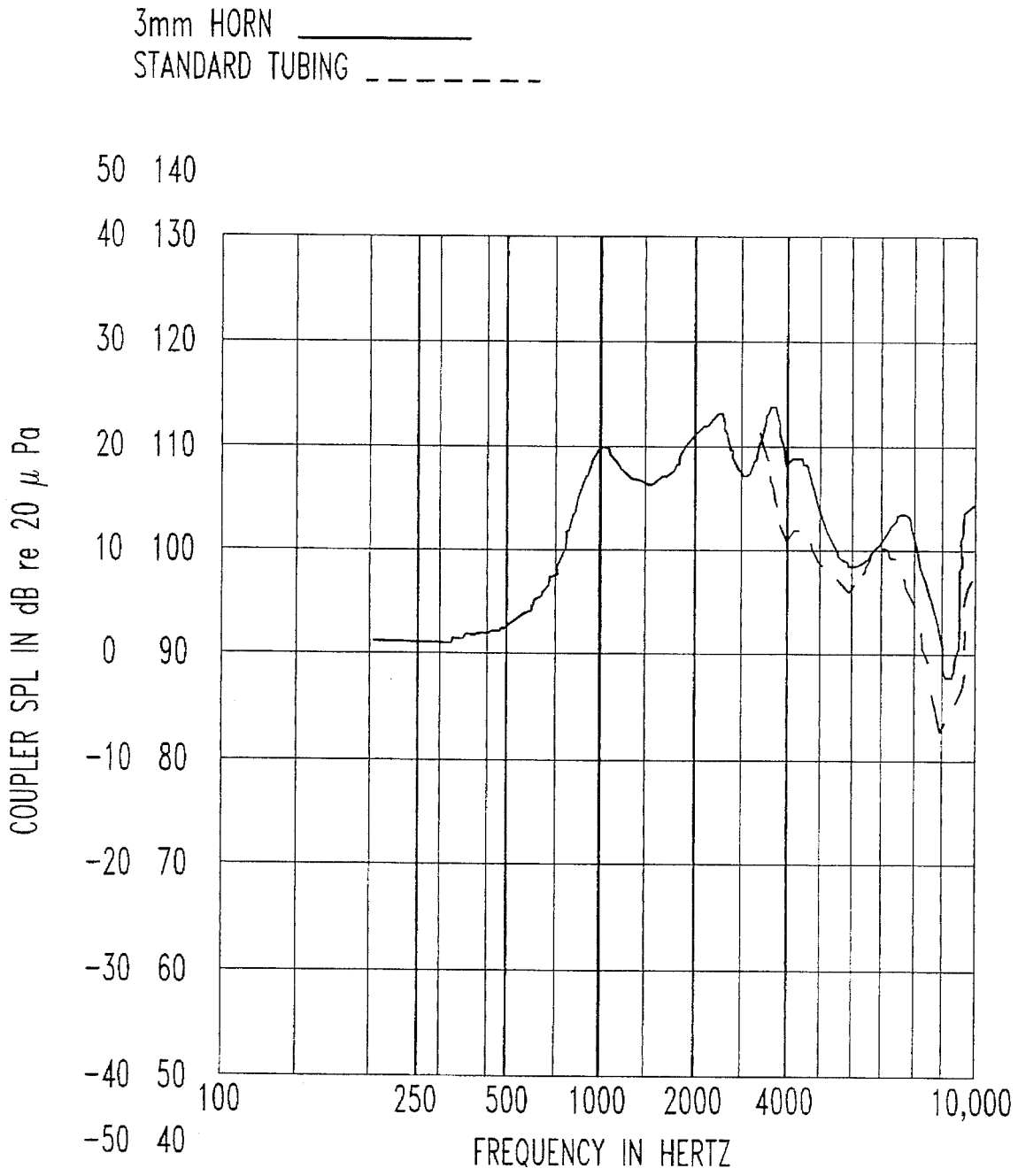
FIG. 5 is a graph comparing the hearing aid response of the present invention with the hearing aid response of standard sound conduction tubing.

When used with standard tubing, the present invention hearing aid response is as that with conventional tubing and attachments. When the present invention is used with an increase in the diameter of the sound conduction path, enhanced high frequency response is also present as is demonstrated by the graph in FIG. 5. The solid line indicates the hearing aid response using the present invention with an increase in the diameter of the sound conduction tubing 12. The dashed line indicates the hearing aid response using standard tubing. Thus, it can be seen that the present invention introduces superior acoustic performance at higher frequency ranges deviations than those achieved according to accepted practice.

While the present invention has been described in conjunction with an exemplary embodiment thereof, it will be understood that many modifications and variations will be readily apparent to those of ordinary skill in the art. This disclosure and the following claims are intended to cover all such modifications and variations.

What is claimed is:

1. A connector for connecting sound conduction tubing from a hearing aid to a sound conduction bore of an earmold, comprising:

a body member having an outer surface and having a bore therethrough with a first end and a second end, said bore being sized to allow said sound conduction tubing to pass through said bore from said first end to said second end and be snugly received in said bore; and retaining means formed on said outer surface of said body member for engaging said bore of said earmold and retaining said connector therein.

2. A connector as recited in claim 1 wherein said retaining means comprises an inclined stepped portion.

3. A connector as recited in claim 1 wherein said connector is formed from nylon.

4. The connector as recited in claim 1 wherein said body member further comprises a flange at one end for limiting the depth to which said connector can be inserted into said earmold.

5. Apparatus for transmitting sound from a hearing aid to a sound conduction bore of an earmold, comprising:

sound conduction tubing coupled to said hearing aid;

a connector for connecting said tubing to said bore of said earmold, said connector comprising:

a body member having an outer surface and having a bore therethrough with a first end and a second end, said bore being sized to allow said sound conduction tubing to pass through said bore and be snugly received therein, said tubing passing through said bore from said first end to said second end;

retaining means formed on said outer surface of said body member for engaging said bore of said earmold and retaining said connector therein; and means for attaching said connector to said tubing.

6. The apparatus of claim 5 wherein said sound conduction tubing increases in interior diameter.

7. The apparatus of claim 5 wherein said means for attaching comprises an adhesive means.

8. The apparatus of claim 5 wherein said retaining means comprises an inclined stepped portion.

9. The apparatus of claim 5 wherein said connector is formed from nylon.

10. The apparatus as recited in claim 5 wherein said body member further comprises a flange at one end for limiting the depth to which said connector can be inserted into said earmold.

11. Apparatus for transmitting sound from a hearing aid into a user's ear, comprising:

an earmold adapted to be received in the ear of the user, said earmold having a bore therethrough;

sound conduction tubing coupled to said hearing aid;

a connector for connecting said tubing to said bore of said earmold, said connector comprising:

a body member having an outer surface and having a bore therethrough with a first end and a second end, said bore being sized to allow said sound conduction tubing to pass through said bore and be snugly received therein, said tubing passing through said bore from said first end to said second end;

retaining means formed on said outer surface of said body member for engaging said bore of said earmold and retaining said connector therein; and means for attaching said connector to said tubing.

12. The apparatus of claim 11 wherein said bore in said earmold has a larger interior diameter at a point adjacent the ear canal of the user and a smaller diameter at a point remote from the user's ear canal.

13. The apparatus of claim 11 wherein said means for attaching comprises an adhesive means.

14. The apparatus of claim 11 wherein said earmold is formed from silicone.

15. The apparatus of claim 11 wherein said connector is formed from nylon.

16. The apparatus as recited in claim 11 wherein said body member further comprises a flange at one end for limiting the depth to which said connector can be inserted into said earmold.

* * * * *